US008215080B2

(12) United States Patent
McNeish et al.

(10) Patent No.: US 8,215,080 B2
(45) Date of Patent: Jul. 10, 2012

(54) GUTTER ASSEMBLIES

(75) Inventors: Raibeart W. McNeish, Warrandyte (AU); Liem Rossney, Wantime (AU)

(73) Assignee: No-Sweat Gutters P/L (AU)

( * ) Notice: Subject to any disclaimer, the term of this patent is extended or adjusted under 35 U.S.C. 154(b) by 381 days.

(21) Appl. No.: 12/399,771

(22) Filed: Mar. 6, 2009

(65) Prior Publication Data

US 2009/0229192 A1 Sep. 17, 2009

(51) Int. Cl.
*E04D 13/00* (2006.01)
*E04D 13/08* (2006.01)

(52) U.S. Cl. ..... 52/741.1; 52/12; 52/13; 52/14; 52/15; 52/16; 52/11

(58) Field of Classification Search ..... 52/11–16
See application file for complete search history.

(56) References Cited

U.S. PATENT DOCUMENTS

| | | | | | |
|---|---|---|---|---|---|
| 4,061,151 | A | | 12/1977 | Ward | |
| 4,411,108 | A | | 10/1983 | Kerester | |
| 4,745,657 | A | * | 5/1988 | Faye | 16/226 |
| 4,807,406 | A | * | 2/1989 | Densmore | 52/11 |
| 5,274,965 | A | * | 1/1994 | Jackson | 52/11 |
| 5,335,460 | A | * | 8/1994 | Smith, Jr. | 52/11 |
| 5,357,719 | A | * | 10/1994 | Lewis | 52/11 |
| 5,417,015 | A | * | 5/1995 | Coyne | 52/11 |
| 5,526,611 | A | * | 6/1996 | Leahy | 52/11 |
| 5,649,681 | A | * | 7/1997 | Faye | 248/48.1 |
| 5,893,239 | A | | 4/1999 | Leahy | |
| 6,233,876 | B1 | * | 5/2001 | Obidniak | 52/16 |
| 6,240,679 | B1 | * | 6/2001 | Smalara | 52/16 |
| 6,389,755 | B1 | * | 5/2002 | Wenner | 52/16 |
| 6,964,135 | B1 | * | 11/2005 | Slodov | 52/11 |
| 7,152,376 | B2 | * | 12/2006 | Wyatt | 52/11 |
| 7,428,799 | B1 | * | 9/2008 | Frelier | 52/11 |
| 7,610,721 | B1 | * | 11/2009 | Frelier | 52/11 |
| 7,891,141 | B2 | * | 2/2011 | Kennedy | 52/11 |
| 2003/0033756 | A1 | * | 2/2003 | Adams et al. | 52/11 |
| 2005/0045738 | A1 | * | 3/2005 | Baxter | 239/208 |
| 2008/0163562 | A1 | * | 7/2008 | Conant | 52/16 |
| 2009/0249702 | A1 | * | 10/2009 | Desotell et al. | 52/11 |
| 2009/0249703 | A1 | * | 10/2009 | Desotell et al. | 52/12 |
| 2010/0043831 | A1 | * | 2/2010 | Koenig | 134/22.12 |

FOREIGN PATENT DOCUMENTS

| | | | |
|---|---|---|---|
| AU | 200165572 | A1 | 2/2003 |
| AU | 2003100926 | A4 | 1/2004 |
| AU | 2005100077 | A4 | 4/2005 |
| JP | 2004116265 | A | 4/2004 |

* cited by examiner

*Primary Examiner* — Mark Wendell
(74) *Attorney, Agent, or Firm* — Dunlap Codding, P.C.

(57) ABSTRACT

A gutter assembly for collecting and channelling rainwater run-off from a roof structure, including: one or more elongate gutter members; at lease one mounting bracket for pivotably mounting each gutter member at the roof structure such that each gutter member is movable between an in-use collecting and channelling position and a substantially inverted cleaning position; and, at least one actuator which acts on one or more gutter members to move the gutter member by generating a pushing force to pivot the gutter member about the mounting bracket to the cleaning position and pulling force to cause the gutter member to return to the in-use position.

18 Claims, 10 Drawing Sheets

GUTTER ASSEMBLIES

CROSS-REFERENCE TO RELATED APPLICATIONS

The present application claims priority to PCT/AU2006/001317, filed Sep. 8, 2006, in accordance with 35 U.S.C. §119 and §365, the entirety of which PCT application is hereby incorporated herein by reference.

BACKGROUND OF THE INVENTION

The present invention relates to a gutter assembly for installation on a building for collecting and channelling rainwater run-off from the building's roof, and more particularly, to a means of actuating movement of the gutter assembly from an in-use collecting and channelling position to a substantially inverted cleaning position.

As is well known, gutters are typically mounted to a fascia board or similar structural member at the eaves of a roof and extend around the periphery thereof. In order to properly fulfil the function of collecting rainwater run-off from the roof and channelling that water away to a drain or water storage tank, the guttering needs to be maintained clear of leaves, twigs and other debris which tends to accumulate in the guttering from surrounding trees. Moreover, allowing debris to build up within the gutters causes the guttering to deteriorate prematurely.

The problems associated with cleaning and maintaining gutters are also quite well known. The biggest impediment in this regard is the problem of access. Access is a problem not only in relation to guttering being located several metres above the ground, and particularly so in multi-level buildings, but also in relation to access to the channel of the guttering itself which is often quite narrow and partially obstructed by the roofing. Since guttering tends to extend in substantial lengths, access is also generally required along the entire length of the gutter.

Cleaning of conventional guttering invariably involves the person responsible for maintenance of the gutters climbing a ladder in order to reach the gutters and may even involve this person precariously balancing themselves on the edge of the roof of the building to facilitate access to the gutter assembly. Such gutter cleaning procedures are both time consuming and dangerous.

Past attempts have been made to develop hinged or pivotally mounted gutter assemblies to facilitate the cleaning and maintenance process. Many of these arrangements however, include a high initial cost associated with installation and component failures rendering the system either inoperable or of reduced benefit. Moreover, although some of these prior art arrangements enable pivoting of the gutter assembly to be actuated from a ground position, they require manual interaction of an operator with the gutter assembly. Such mechanisms for actuating tilting of the gutters are likely to contravene health and safety regulations since they will typically involve an operator actuating the tilting mechanism using a hook-like implement mounted on an extensible pole whilst standing beneath the gutter to be tilted.

It is therefore an aim of the present invention to provide an improved means of actuating titling of a gutter assembly to facilitate gutter cleaning and maintenance.

SUMMARY OF THE INVENTION

According to an aspect of the present invention, there is provided a gutter assembly for collecting and channelling rainwater run-off from a roof structure, including:

one or more elongate gutter members;

at least one mounting bracket for pivotably mounting each gutter member at the roof structure such that each gutter member is movable between an in-use collecting and channelling position and a substantially inverted cleaning position; and at least one actuator which acts on one or more gutter members to move the gutter member by generating a pushing force to pivot the gutter member about the mounting bracket to the cleaning position and a pulling force to cause the gutter member to return to the in-use position.

In a preferred form of the present invention, the actuator is a linear actuator having a body portion and a tube portion. More preferably, the actuator causes the tube to alternately extend or retract from the body portion, wherein extension of the tube generates the pushing force to move the gutter member to the cleaning position and retraction of the tube generates the pulling force to cause the gutter member to return to the in-use position.

In another form of the present invention, a predetermined maximum pivot angle is used to define a range of movement between the in-use position and the cleaning position. Preferably, a restraining member is used to prevent the gutter member from pivoting beyond the predetermined maximum pivot angle.

The actuator of the present invention may be mounted on a fascia board substantially parallel to the gutter member.

According to yet another embodiment of the present invention, a substantially resilient tube extension portion is used to transfer the pushing and pulling force from the actuator to the gutter member. Preferably, the substantially resilient extension portion is coupled to the gutter member via an angulated mounting plate.

The actuator may be programmed to cause the gutter to move between the in-use and cleaning positions at predetermined intervals. Moreover, the actuator may be programmed to move the gutter members between the in-use and cleaning positions either simultaneously or sequentially.

According to another aspect of the present invention, there is provided a gutter assembly for collecting and channelling rainwater run-off from a roof structure, including:

a plurality of gutter members;

each of the gutter members including an angle or corner portion forming a continuous rain water channel around a corner;

at least one of the gutter members including an outlet formed in the base portion for fluid communication with a drain pipe, the outlet including a opening for passage of water out of the gutter member, and a flow guide means configured to direct water passing through the outlet opening into the drain pipe; at least one mounting bracket for pivotably mounting each gutter member at the roof structure such that each gutter member is movable between an in-use collecting and channelling position and a substantially inverted cleaning position; and at least one actuator which acts on one or more gutter members to move the gutter member by generating a pushing force to pivot the gutter member about the mounting bracket to the cleaning position and a pulling force to cause the gutter member to return to the in-use position.

In one embodiment of the present invention, the actuator is a linear actuator having a body portion and a tube portion. Preferably, the actuator causes the tube to alternately extend or retract from the body portion, wherein extension of the tube generates the pushing force to move the gutter member to the cleaning position and retraction of the tube generates the pulling force to cause the gutter member to return to the in-use position.

The actuator may be mounted on a fascia board substantially parallel to the gutter member.

In a particular form of the present invention, a substantially resilient tube extension portion is used to transfer the pushing and pulling force from the actuator to the gutter member.

According to yet another aspect of the present invention, there is provided an actuator for causing one or more gutter members to pivot about a mounting bracket between an in-use collecting and channelling position and a substantially inverted cleaning position, including:

a body portion and a tube portion;

wherein the actuator causes the tube portion to alternately extend or retract from the body portion, wherein extension of the tube generates the pushing force to move the gutter member to the cleaning position and retraction of the tube generates the pulling force to cause the gutter member to return to the in-use position.

In one embodiment, the tube portion includes a substantially resilient tube extension to transfer the pushing and pulling force from the actuator to the gutter member.

According to yet another aspect of the present invention, there is provided a method for cleaning a gutter assembly for collecting and channelling rainwater run-off from a roof structure, the gutter assembly including one or more elongate gutter members, at least one mounting bracket for pivotably mounting each gutter member at the roof structure such that each gutter member is movable between an in-use collecting and channelling position and a substantially inverted cleaning position, and at least one actuator, the method including the following steps:

causing the actuator to generate a pushing force to pivot the gutter member about the mounting bracket from the in-use collecting and channelling position to the substantially inverted cleaning position;

maintaining the gutter member in the substantially inverted cleaning position for a predetermined period of time; and causing the actuator to generate a pulling force to return the gutter member from the substantially inverted cleaning position to the in-use collecting and channelling position.

Preferably, the above method is preceded by the step of programming the actuator to cause the gutter to move between the in-use and cleaning positions at predetermined intervals. The actuator may also be programmed to move the gutter members between the in-use and cleaning positions simultaneously or sequentially.

BRIEF DESCRIPTION OF THE DRAWINGS

The invention will hereinafter be described in greater detail with reference to the attached drawings that illustrate an example form of the invention. It is to be understood that the particularity of those drawings does not supersede the generality of the preceding description of the invention.

DETAILED DESCRIPTION OF THE INVENTION

Figure 1:
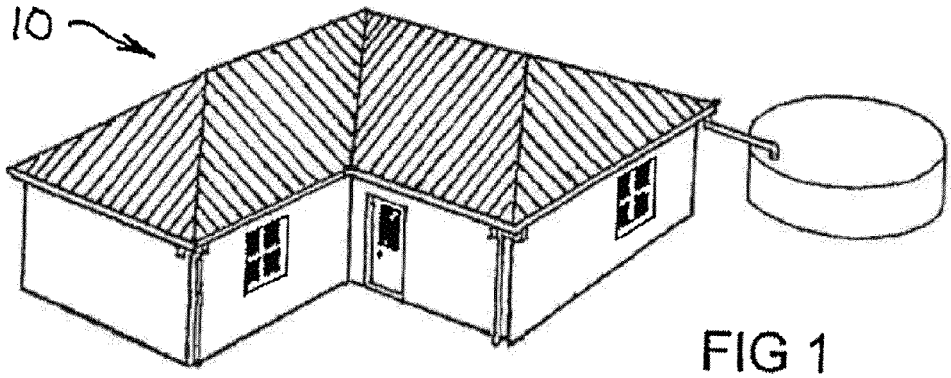
FIG. 1 is a perspective view of a typical roof structure.

Referring firstly to FIG. 1, there is shown a typical roof structure 10 in a domestic environment. The gutter assembly of the present invention has particular application to domestic buildings or housing and it will be convenient to hereinafter describe it in this context. It is to be appreciated, however, that the gutter assembly of the invention is not limited to application in domestic buildings and that they may be used with a wide variety of buildings and structures.

Referring to FIG. 2, there is shown a gutter assembly 12 for collecting and channelling run-off from a roof structure 10. The gutter assembly includes one or more gutter members 14 which typically extend around the perimeter of the roof structure positioned adjacent to and just below the actual roof decking 16. Each gutter member 14 has a generally U-shaped transverse cross-section defined by opposing upright portions 18 interconnected by a base portion 20.

Each gutter member 14 is pivotably mounted to a fascia board 22 of the roof structure 10 using one or more mounting brackets 24. Each gutter member 14 is pivotably mounted by direct connection to the base portion 20 of the gutter member 14. The mounting brackets 24 facilitate movement of each gutter member 14 between an in-use collecting and channelling position (as shown in FIG. 2*a*) and a substantially inverted cleaning position (as shown in FIG. 2*b*).

Figure 3:
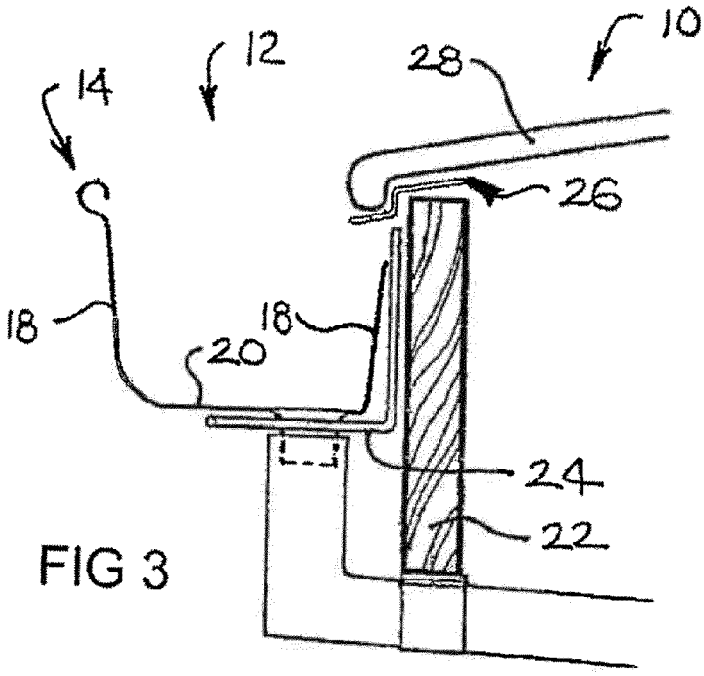
FIG. 3 is a cross-sectional view of the gutter assembly shown in FIGS. 2*a* and 2*b*, this time installed at a tiled roof structure and including additional flashing.
Figure 4:
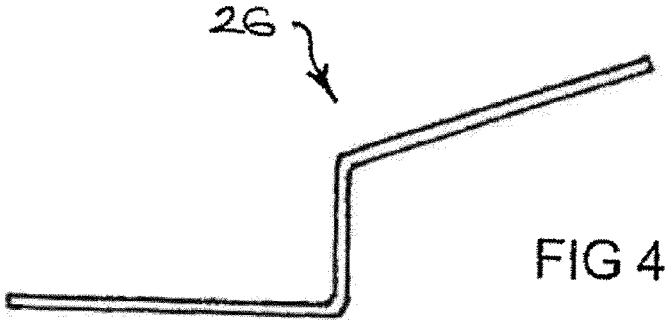
FIG. 4 is a perspective view of a flashing element for the gutter assembly shown in FIG. 3.
Figure 2A:
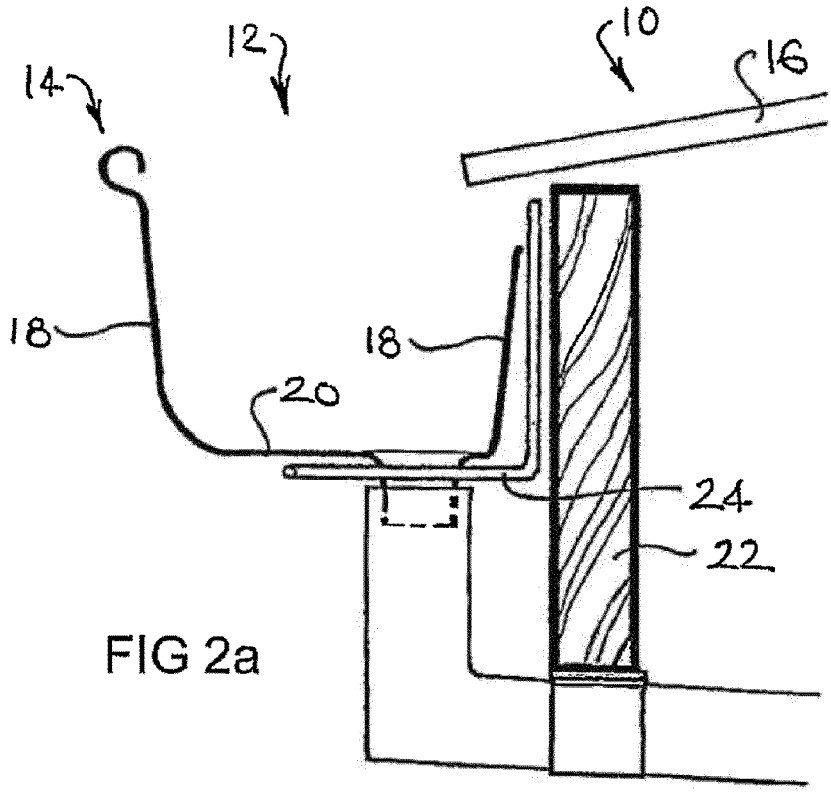
FIG. 2*a* is a cross-sectional view of a gutter assembly, the gutter member being installed at a roof structure with the gutter member shown in the in-use collecting and channelling position.
Figure 2B:
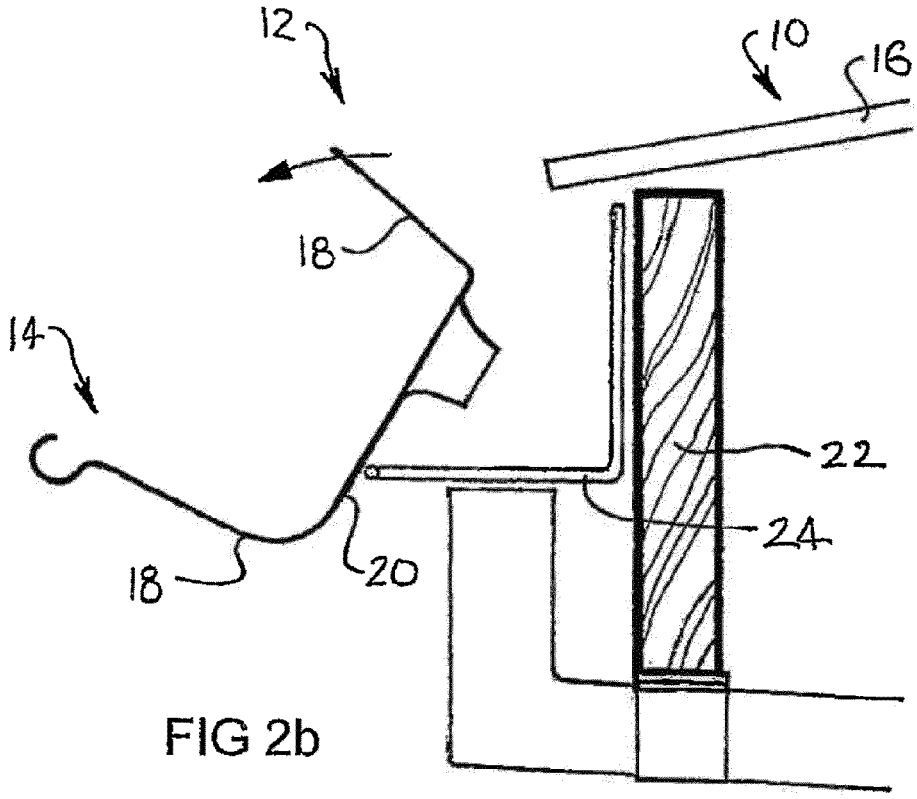
FIG. 2*b* is a cross-sectional view of the gutter assembly of FIG. 2*a* with the gutter member shown in the substantially inverted cleaning position.

Referring now to FIG. 3, there is shown a similar gutter assembly 12 to that shown in FIGS. 2*a* and 2*b*. However, in this case the roof decking 16 is tiled and the gutter assembly 12 incorporates a flashing strip 26. The flashing strip 26 is shown in more detail in FIG. 4 and extends parallel to the gutter members 14 and is positioned between the roof tiles 28 and the fascia board 22. The flashing strip 26 may be formed from any suitable material, such as steel or aluminium.

Examples of mounting brackets 24 for the gutter assembly 12 are shown in FIGS. 5 to 8. In general, each mounting bracket 24 is substantially L-shaped with a substantially vertical or upright portion 30 and a substantially horizontal, cantilevered support portion 32 which is configured to extend below and to be fastened directly to the base portion 22 of the gutter member 12. The bracket examples shown in FIGS. 5 to 8 include a metal wire which has been bent or formed to provide the general right-angle or L-shaped configuration described.

Figure 5:
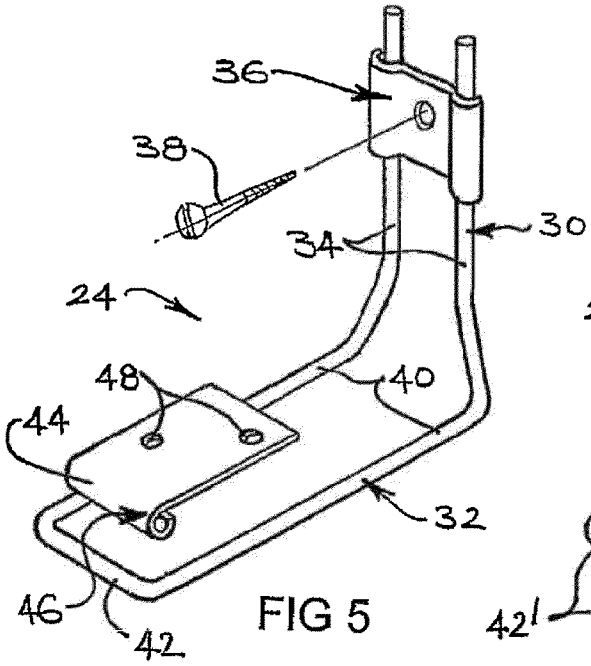
FIG. 5 is a perspective view of a bracket for a gutter assembly.

Referring now to FIG. 5, the substantially vertical portion 30 includes a pair of wire elements 34 interconnected by a mounting clip 36 by means of which the mounting bracket 24 is attached to the fascia board 22. The mounting bracket 24 is secured to the fascia board 22 by means of a suitable fastening element, such as a screw 38. The mounting clip 36 slides on the wire elements 34 to provide height adjustability for the mounting bracket 24. The substantially horizontal, cantilevered support portion 32 includes a pair of parallel wire elements 40 which, at one end, are integral with and extend from the wire elements 34 of the upright portion 30 and which, at their opposite ends, are interconnected by a wire element 42. The mounting bracket 24 further includes a hinge strip 44 having a loop 46 by which the hinge strip is pivotably arranged on the wire element 42. The hinge strip 44 further includes holes 48 for use when the mounting bracket 24 is fastened to the base portion 20 of an associated gutter member 14.

Figure 6:
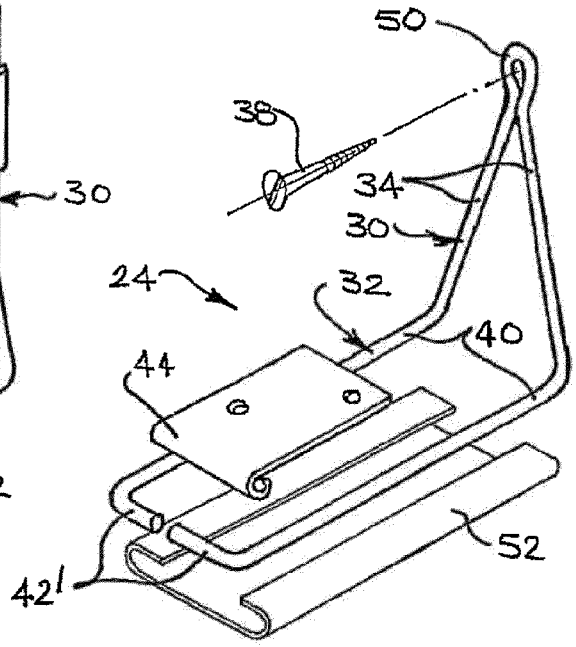
FIG. 6 is a perspective view of an alternative bracket for a gutter assembly.
Figure 7:
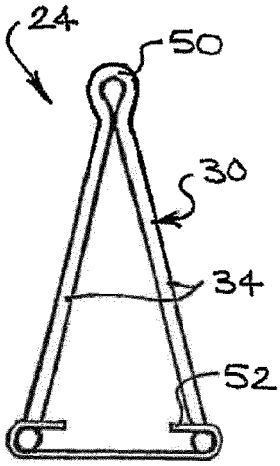
FIG. 7 is a front view of the bracket shown in FIG. 6.

Alternative mounting bracket 24 shown in FIGS. 6 and 7 is similar to that shown in FIG. 5. In this case however, the free ends of the wire are in the substantially horizontal, cantilevered support portion of the 32 of the mounting bracket 24 rather than the upright mounting portion 30. Accordingly, the hinge strip 44 is pivotably arranged on the separate wire elements 42' arranged at the end of each of the supporting wire elements 40. The upright wire elements 30 are integrally joined at an apex and are formed in a loop 50 for receiving the fastening screw 38. The mounting bracket 24 also includes a rigid sleeve 52 which slides over the wire elements 40 to prevent the support tubes from being moved apart.

Figure 8:
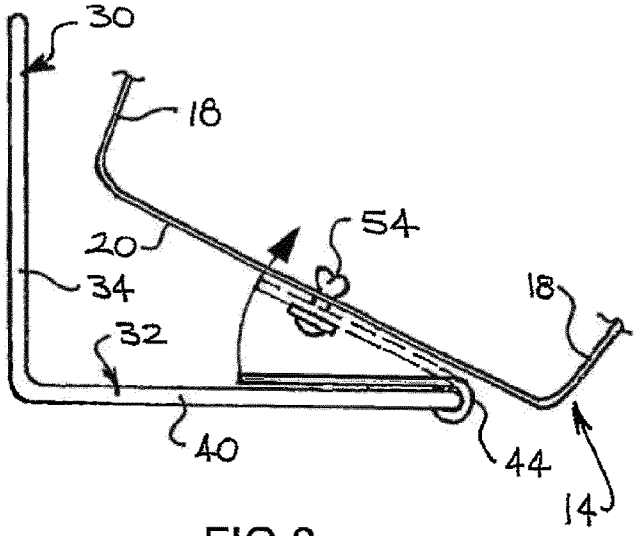
FIG. 8 is a side view of a gutter assembly showing the gutter member fastened directly to the hinge of a bracket member as shown in FIG. 5 or 6.

As can be seen in FIG. 8, the gutter member 14 is directly fastened to the hinge strip 44 of the mounting bracket 24. A rivet 54 passes through one of the holes 48 in the hinge strip 44 and is fastened through the base portion 20 of the gutter member 14 at a position substantially midway between the opposing upright portions 18. The pivot axis for the pivotable mounting of the gutter member 14 is coaxial with the wire element 42 around which the hinge strip loop 46 extends. Thus, in the in-use position, the pivot axis is located transversely outwardly of the rivet fastening to the base portion 20. Two rivets can be provided for each hinge strip 44 and each of the riveted connections can be sealed against water leakage, for example with a silicon gel.

Figure 9:
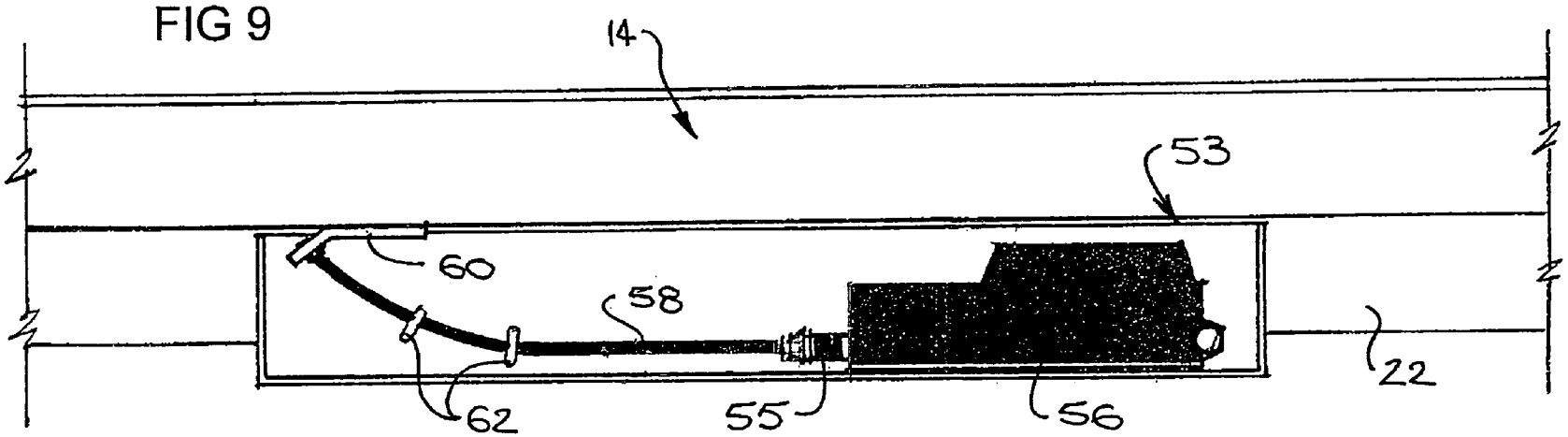
FIG. 9 is a side on view of an actuator for tilting the gutter assembly according to an embodiment of the present invention.

Referring now to FIG. 9, according to the present invention the gutter members 14 are caused to move between the in-use collecting and channelling position and the substantially inverted cleaning position by means of an actuator 53 which exerts a force directly on each gutter member 14. The force of the actuator 53 causes the gutter member 14 to pivot about the mounting bracket 24. A pushing force is exerted on the gutter member 14 to move the gutter member 14 from the in-use position to the substantially inverted position, and a pulling force returns the gutter member 14 to the in-use position once gutter cleaning is complete. Gutter cleaning may involve washing the gutter members 14 using a hose or similar or may simply involve inverting the gutter members 14 to dislodge any loose debris.

In one embodiment, the actuator is a linear actuator. Preferably, the actuator 53 uses an electric motor to produce rotational motion to spin a gearbox. The gearbox is connected to the base of a threaded shaft which is mounted inside a tube 55. When the shaft is turned via the motor and the gears, it is caused to ride up or down the thread depending on the direction of rotation causing extension or retraction of the tube 55 from the actuator body 56. Extension of the tube 55 causes a pushing force to move the gutter member 14 to the cleaning position and retraction of the tube 55 causes pulling force to return the gutter member 14 to the in-use position.

A predetermined angle of rotation or pivot may define the range of movement between the in-use position and the cleaning position. That is, the degree of pivot permitted to move the gutter member 14 to the substantially inverted position is controlled. This can be achieved either by use of some physical restraint such as a length of chain or similar to prevent the gutter member 14 tilting beyond a certain point, or may be controlled by the actuator itself, that is, by limiting the degree of extension of the tube 55.

Figure 11:
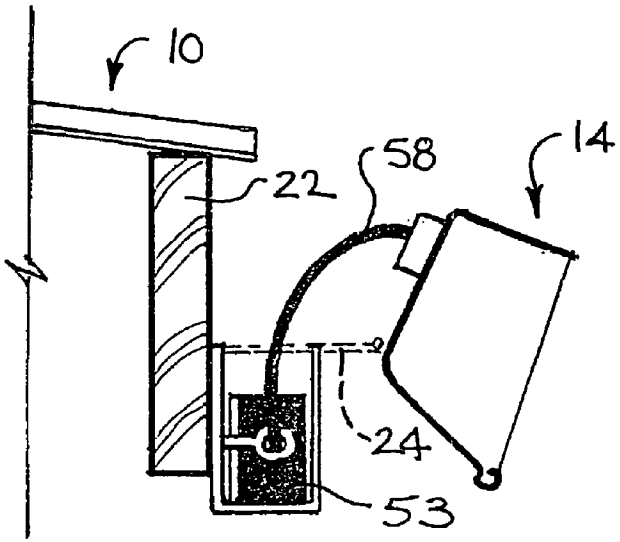
FIG. 11 is a section view of the actuator and gutter assembly of FIGS. 9 and 10 showing the gutter in the substantially inverted cleaning position.
Figure 10:
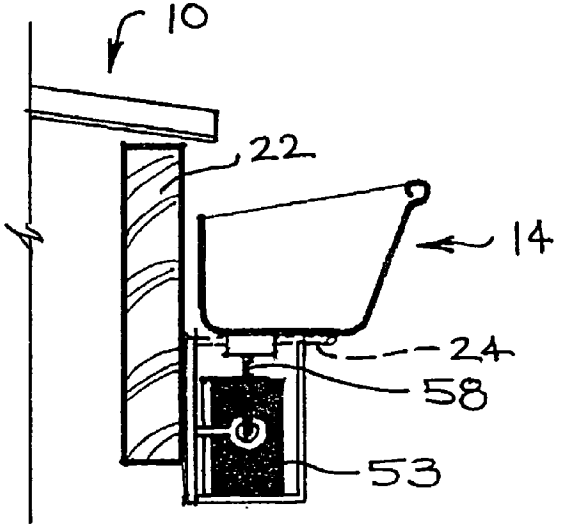
FIG. 10 is a section view of the actuator and gutter assembly of FIG. 9 showing the gutter in the in-use collecting and channelling position.

As shown in FIGS. 9 to 11, in the preferred embodiment, the actuator 53 is mounted on a fascia board 22 substantially parallel to and underneath the gutter member 14. Alternative, arrangements may involve mounting of the actuator 53 outside of the gutter member 14 such as behind the fascia board 22 or within the roof cavity. However, for ease of maintenance and servicing of the actuator 53, it is preferable to mount the actuator 53 in a readily accessible location.

Furthermore, the tube 55 includes a tube extension in the form of a substantially resilient portion 58. The resilient portion 58 extends from the tube portion 53 and transfers the pushing or pulling force provided by the actuator 53 to the gutter member 14. Due to the position of the actuator 53 parallel to the gutter member 14 and the tilting action of the gutter member 14, the resilient portion 58 requires a degree of flexibility to facilitate the transfer of forces once the gutter member 14 has been moved out of the in-use position.

The substantially resilient portion 58 is preferably provided in the form of strengthened cable whose properties facilitate flexing of the extension whilst minimizing the likelihood that the cable will kink. A suitable example of such a resilient portion 58 is a cable having a steel core covered in a plastic sleeve. Any kinking in the cable may cause a faulty transfer of energy to the gutter member 14 and result in the gutter member 14 not being moved between the in-use and cleaning positions as intended.

In a preferred embodiment, the substantially resilient portion 58 is coupled to the gutter member 14 via an angulated mounting plate 60 to facilitate this transfer of forces. One or more ring guides 62 may be provided to guide the resilient portion 58 along the fascia board 22.

The actuator 53 is associated with a control interface which is preferably programmable to enable the actuator 53 to be programmed to automatically cause the gutter member 14 to move between the in-use and cleaning positions at predetermined intervals.

Preferably, one actuator 53 is provided to drive each gutter member 14 or length of gutter member 14. The maximum length of a single gutter member 14 will be determined by the maximum length that the gutter member 14 can be before tilting of the gutter member 14 driven by the actuator 53 causes the gutter member 14 to deform or twist. The actuator 53 may be programmed to move the individual gutter members 14 between the in-use and cleaning positions either simultaneously or sequentially.

Figure 12:
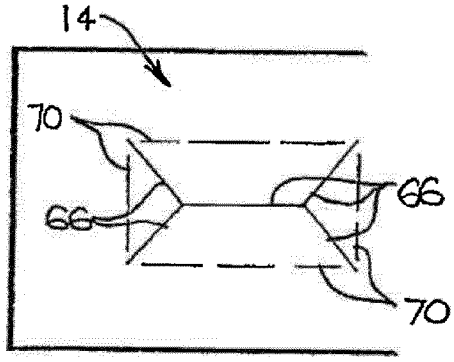
FIGS. 12, 13 and 14 show the formation of a rectangular shaped outlet in the base portion of the gutter member.
Figure 13:
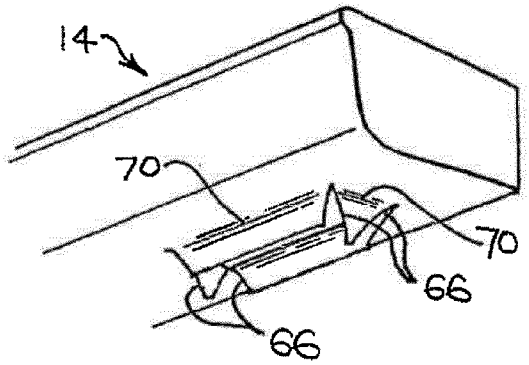
Figure 14:
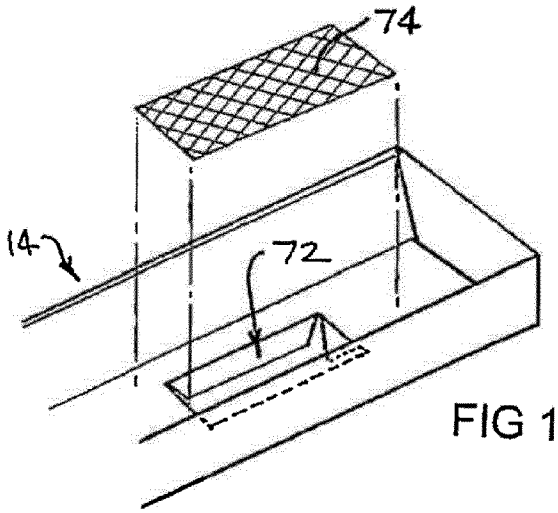
Figure 15:
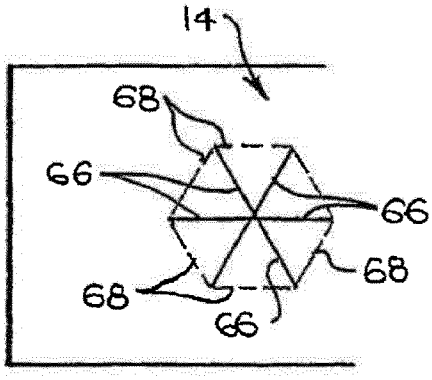
FIGS. 15 and 16 show the formation of a round or circular shaped outlet in the base portion of the gutter member.
Figure 16:
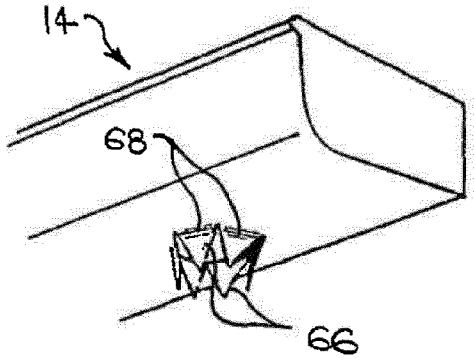

FIGS. 12 to 16 illustrate the formation of an outlet 64 in each gutter member 14. Each outlet 64 is preferably formed by cutting slits 66 in the base portion 20. For example, cutting five slits 66 in a configuration as shown in FIG. 12 creates four tabs 68 which are foldable about the fold lines (shown as broken lines). Referring now to FIG. 13, when the tabs 68 are folded downwardly a generally rectangular opening 72 is created through the base portion 20 and the folded tabs 68 themselves form a guide for directing flow of the rainwater in the gutter member 14 into an adjacent drainage tube or pipe. In addition, as shown in FIG. 14, a screen or mesh panel 74 may be provided across the outlet opening 72 to prevent larger objects such as leaves and twigs from becoming stuck in the drainage pipe and possibly causing a blockage. The rectangular outlets 64 shown in FIGS. 12 to 14 are designed for communication with the open upper end of drain pipes or "down-pipes" having a rectangular cross-section. FIGS. 15 and 16 show the formation of an outlet 64 for communication with a round or circular cross-section drainage pipe.

Figure 17:
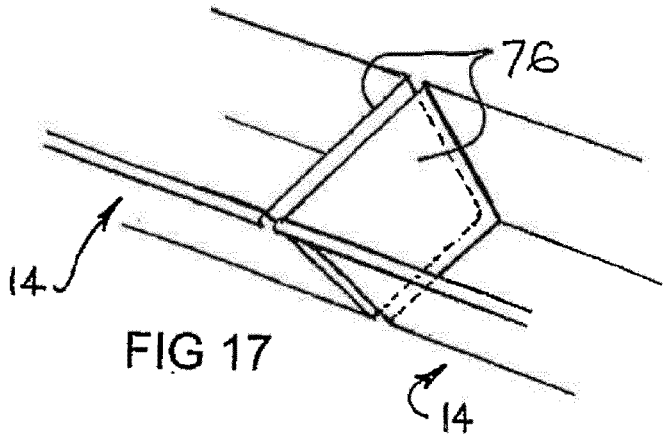
FIG. 17 is a perspective view of a gutter member showing the respective ends thereof closed off by an end wall.
Figure 18:
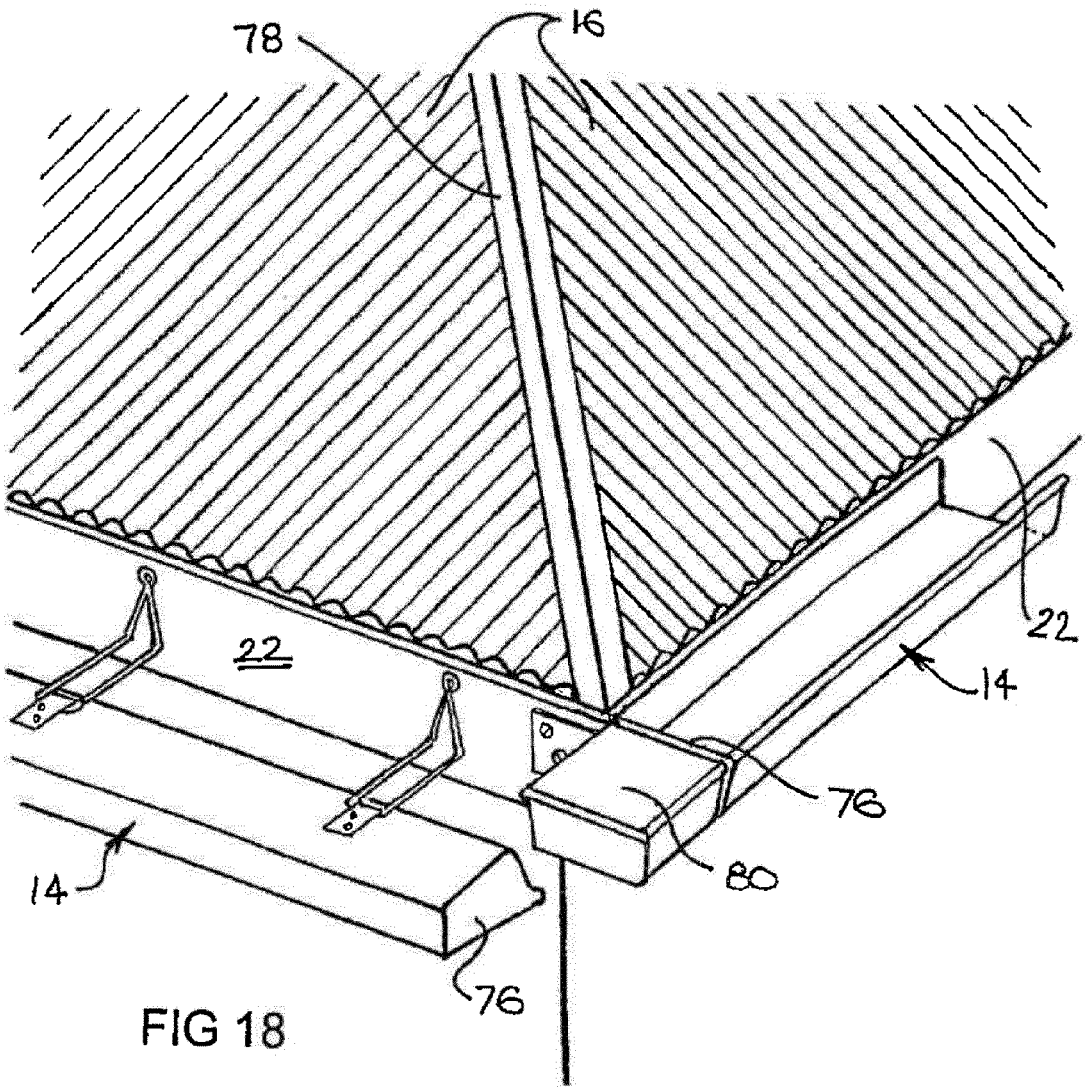
FIGS. 18 and 19 are perspective views showing the gutter assembly at an external corner of a roof structure.
Figure 19:
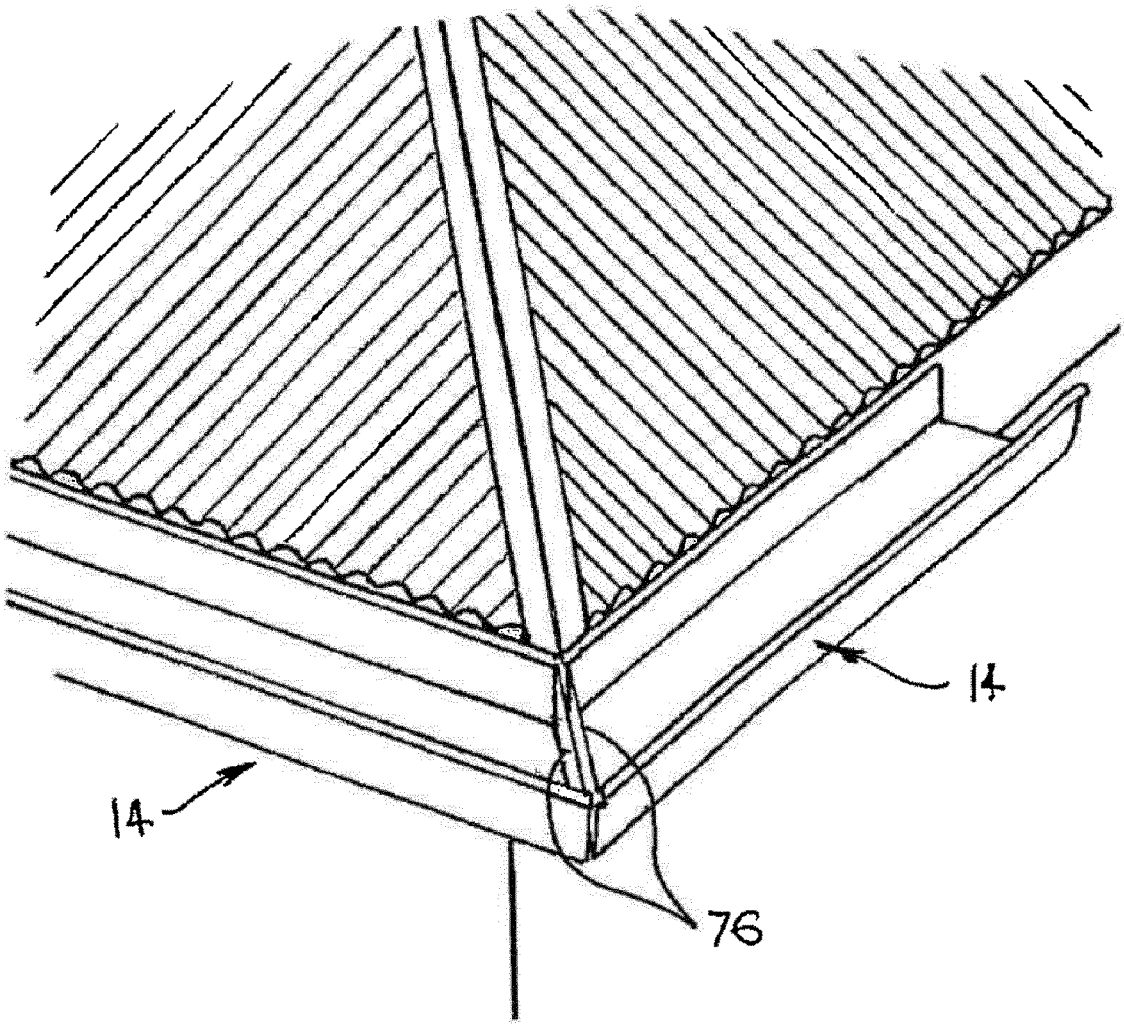

Referring now to FIG. 17, the elongate gutter members 14 in the gutter assembly 12 are provided in straight lengths and each length is desirably closed by an end wall 76 at opposite end regions thereof. At what is herein referred to as an "external" corner of a roof structure (i.e. where two planar expanses of the roof decking 16 meet at a roof ridge 78) as shown in FIG. 18, the end walls 76 of each gutter member 14 may simply extend squarely transverse the longitudinal extent of the gutter member. The vacant square of space between the gutter members meeting at that corner may optionally be occupied or filled with an end block 80 screwed or bolted to the fascia board 22 of the roof structure. Alternatively, as shown in FIG. 19, the gutter members 20 may be provided with mitred end walls 76 so that the gutter members meet diagonally at the external corner. A further option is that the end walls 76 may be squarely transverse the longitudinal extent of the gutter members 14 as before with a mitred portion (optionally solid) simply provided for decorative appeal.

Figure 20:
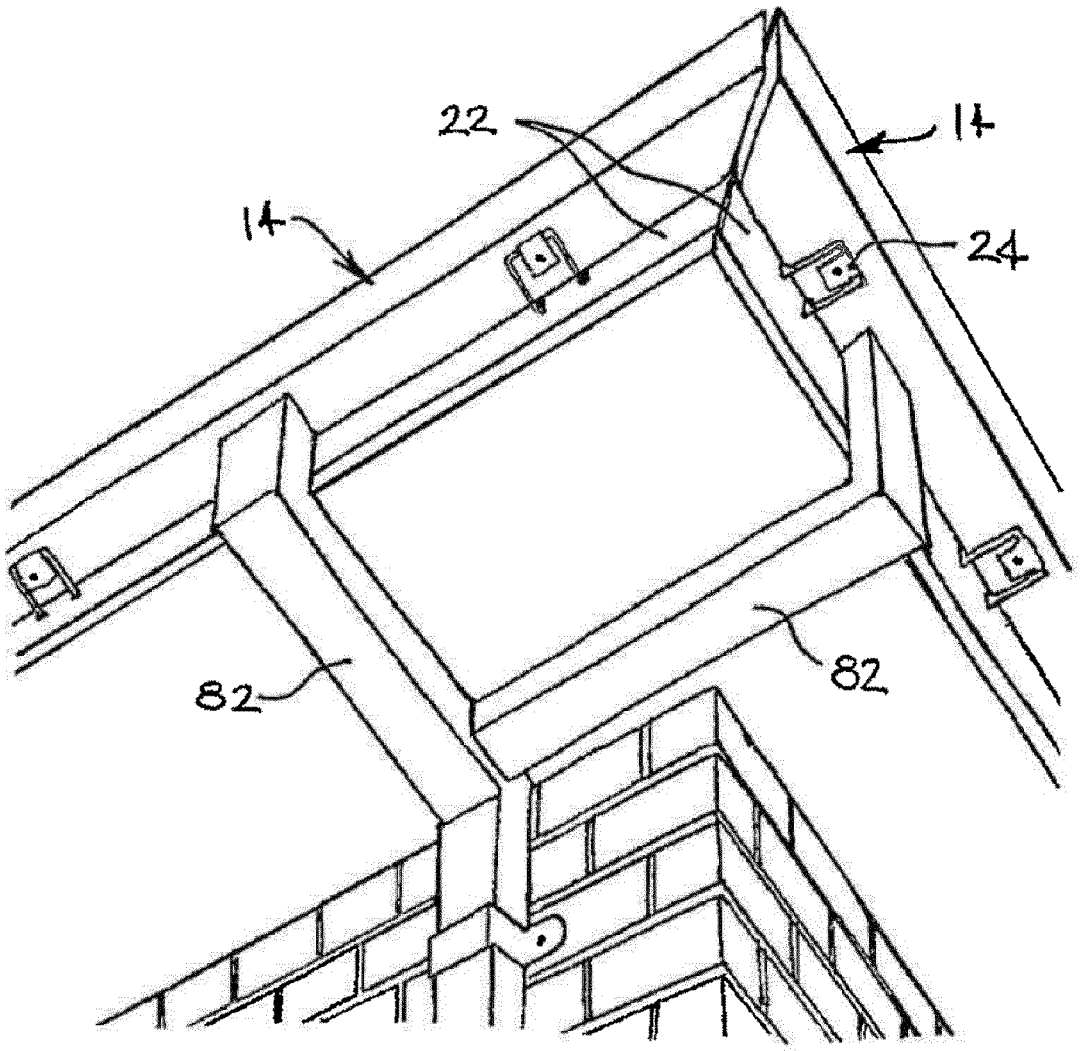
FIG. 20 is a perspective view of a downpipe arrangement.
Figure 21:
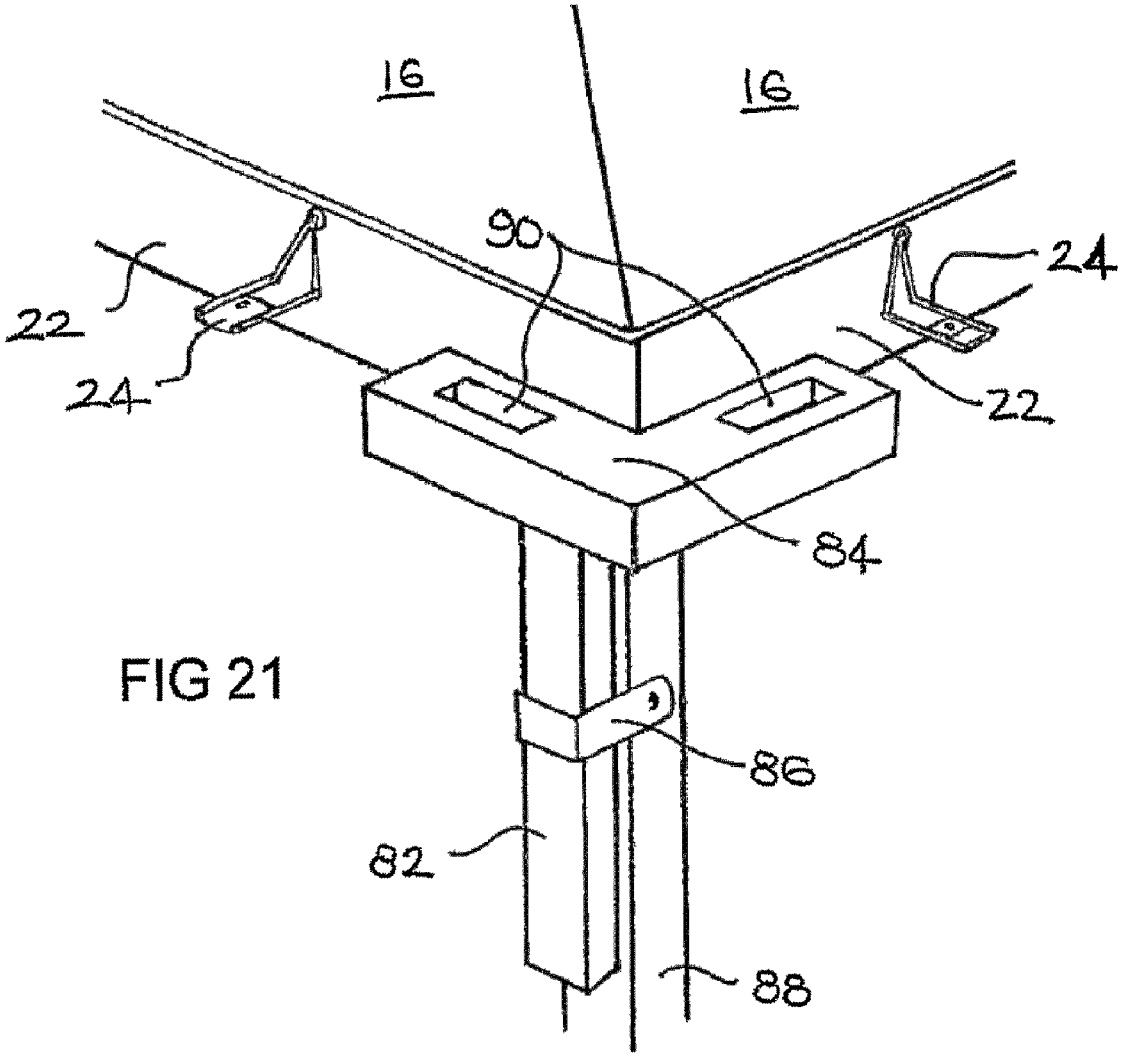
FIG. 21 is a perspective view of a rain head for an external corner of a gutter assembly.

With each of the gutter members 14 being closed at its opposite ends, each gutter member 14 therefore also requires an outlet 64. The gutter assembly 12 will therefore typically require a greater number of downpipes as compared with standard non-pivotable guttering. Accordingly, downpipes 82 may be combined as shown in FIG. 20. Alternatively, a rainhead 84 may be provided on a single downpipe 82 as shown in FIG. 21 fastened with a metal strap 86 to a verandah post 88. The rainhead 84 includes two rainwater inlets 90, each adapted to receive a respective flow guide (e.g. tabs 66) at the outlet 64 of the respective gutter members 14 meeting at that corner. The rainhead 84 is similarly designed to simplify the additional drainage requirements necessitated by the pivotable gutter assembly.

Figure 22:
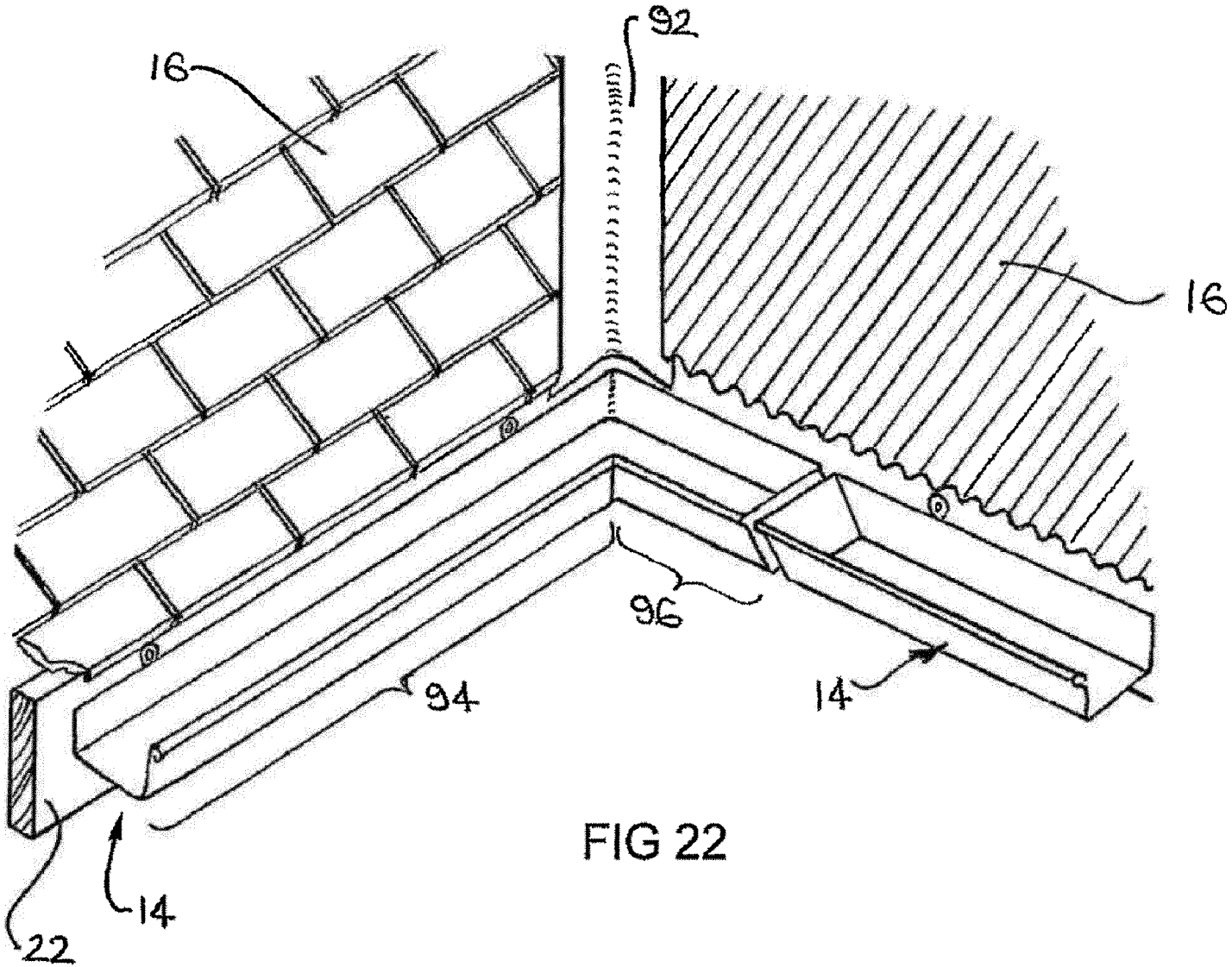
FIG. 22 is a perspective view of the gutter assembly at an internal corner of a roof structure.

With reference now to FIG. 22, it will be appreciated that the gutter assembly may include a gutter member 14' which incorporates a corner, that is, a gutter member which is not simply straight but which is angled to form a continuous rainwater channel around a corner. This particular gutter member 14' is adapted for so-called "internal" roof corners where planar expanses of roof decking 16 intersect at a roof valley 92. This angled gutter member 14' is able to extend right into the internal roof corner to collect all of the rainwater run-off from the roof valley 92. The angled gutter member 14' has an elongate and substantially straight length 94 combined with a relatively short length 96 which extends at an angle (typically 90°) to form a continuous gutter channel through the corner. The elongate length 94 of the angled gutter member 14' is mounted at the roof structure 10 using mounting brackets 24 in the usual way. The relatively short angled length 96 is not itself mounted on mounting brackets therefore forms a cantilevered extension of the length 94. The end wall 76' of the short length 96 is angled to complement the angled end wall 76 of the adjacent gutter member 14. This angling of the end walls is to facilitate movement of the gutter member 14' from the in-use position to the inverted cleaning position. When cleaning the gutter members at an internal corner, the angled gutter member 14' is pivoted to the cleaning position first, followed by the adjacent gutter member 14. The short length 96 simply pivots with the main gutter member length 94 about its hinge connection with the mounting brackets 24 in the usual way.

It will be appreciated that the combination of guttering assembly features including the elongate gutter members, pivotable mounting brackets, modified outlets and down pipes, gutter members adapted for external and/or internal corners enable an entire gutter assembly to be moved simultaneously or sequentially between the in-use collecting and channelling position and the substantially inverted cleaning position. The actuator of the present invention provides the means for automating this movement or tilting of the entire gutter assembly by enabling remote operation.

Cleaning of the guttering becomes so simplified that it can be performed on a regular basis without having to access the guttering from a ladder or from the roof itself. That is, the guttering can be cleaned quickly and effectively from ground level by simply causing the actuator to initiate the cleaning process or more desirably, by programming to actuator to perform the cleaning procedure at regular intervals, that is, weekly, monthly or some other predefined interval.

Furthermore, it should be appreciated that various alterations, modifications and/or additions may be introduced into the construction and arrangement of the parts previously described without departing from the spirit or ambit of the present invention.

What is claimed is:

1. A gutter assembly for collecting and channelling rainwater run-off from a roof structure, including:

one or more elongate gutter members;

at least one mounting bracket for pivotably mounting each gutter member at the roof structure such that each gutter member is movable between an in-use collecting and channelling position and a substantially inverted cleaning position; and at least one remotely operable actuator which acts on one or more gutter members to move the gutter member by generating a pushing force to pivot the gutter member about the mounting bracket to the cleaning position and a pulling force to cause the gutter member to return to the in-use collecting and channelling position, and wherein the remotely operable actuator is positioned outside of or underneath the gutter member, and wherein the remotely operable actuator is an electrically powered linear actuator having a body portion and a tube portion which is extendable from the body portion.

2. The gutter assembly of claim 1, wherein the electrically powered linear actuator is able to cause the tube portion to be extended from the body portion to generate the pushing force to move the gutter member to the cleaning position and wherein the tube portion is retractable to generate the pulling force to cause the gutter member to return to the in-use collecting and channelling position.

3. The gutter assembly of claim 1, wherein a predetermined maximum pivot angle defines a range of movement between the in-use collecting and channelling position and the cleaning position.

4. The gutter assembly of claim 3, further comprising a restraining member to prevent the gutter member from pivoting beyond the predetermined maximum pivot angle.

5. The gutter assembly of claim 1, wherein the remotely operable actuator is mounted on a fascia board substantially parallel to the gutter member.

6. The gutter assembly of claim 1, wherein a substantially resilient tube extension portion which extends from the tube portion transfers the pushing and pulling force from the remotely operable actuator to the gutter member.

7. The gutter assembly of claim 6, wherein the substantially resilient extension portion is coupled to an underside of the gutter member.

8. The gutter assembly of claim 1, wherein the electrically powered linear actuator is programmed to cause the gutter member to move between the in-use collecting and channelling position and the cleaning position at predetermined intervals.

9. The gutter assembly of claim 8, wherein the electrically powered linear actuator is programmed to move the gutter members between the in-use collecting and channelling position and the cleaning position simultaneously or sequentially.

10. A gutter assembly for collecting and channelling rainwater run-off from a roof structure, including:

a plurality of gutter members;

each of the gutter members including an angle or corner portion forming a continuous rain water channel around a corner;

at least one of the gutter members including an outlet formed in the base portion for fluid communication with a drain pipe, the outlet including an opening for passage of water out of the gutter member, and a flow guide means configured to direct water passing through the outlet opening into the drain pipe;

at least one mounting bracket for pivotably mounting each gutter member at the roof structure such that each gutter member is movable between an in-use collecting and channelling position and a substantially inverted cleaning position; and at least one remotely operable actuator which acts on one or more gutter members to move the gutter member by generating a pushing force to pivot the gutter member about the mounting bracket to the substantially inverted cleaning position and a pulling force to cause the gutter member to return to the in-use collecting and channelling position, and wherein the remotely operable actuator is positioned outside of or underneath the gutter member, and wherein the remotely operable actuator is an electrically powered linear actuator having a body portion and a tube portion which is extendable from the body portion.

11. The gutter assembly of claim 10, wherein the electrically powered linear actuator is able to cause the tube portion to be extended from the body portion to generate the pushing force to move the gutter member to the cleaning position and wherein the tube portion is retractable to generate the pulling force to cause the gutter member to return to the in-use collecting and channelling position.

12. The gutter assembly of claim 10, wherein the remotely operable actuator is mounted on a fascia board substantially parallel to the gutter member.

13. The gutter assembly of claim 10, wherein a substantially resilient tube extension portion which extends from the tube portion transfers the pushing and pulling force from the remotely operable actuator to the gutter member.

14. A remotely operable electrically powered actuator for causing one or more gutter members to pivot about a mounting bracket between an in-use collecting and channelling position and a substantially inverted cleaning position, including:

a body portion and a tube portion which is extendable from the body portion and is retractable;

wherein the remotely operable electrically powered actuator is able to cause the tube portion to be extended from the body portion, to generate the pushing force to move the gutter member to the cleaning position and wherein the tube portion is retractable to generate the pulling force to cause the gutter member to return to the in-use collecting and channelling position, and wherein the remotely operable actuator is positioned outside of or underneath the gutter member.

15. The actuator of claim 14, wherein the tube portion includes a substantially resilient tube extension which extends from the tube portion to transfer the pushing and pulling force from the remotely operable electrically powered actuator to the gutter member.

16. A method for cleaning a gutter assembly for collecting and channelling rainwater run-off from a roof structure, the gutter assembly including one or more elongate gutter members, at least one mounting bracket for pivotably mounting each gutter member at the roof structure such that each gutter member is movable between an in-use collecting and channelling position and a substantially inverted cleaning position, and at least one remotely operable actuator, wherein the remotely operable actuator is an electrically powered linear actuator having a body portion and a tube portion which is extendable from the body portion, the method including the following steps:

causing the remotely operable actuator to generate a pushing force by extending the tube portion from the body portion to pivot the gutter member about the mounting bracket from the in-use collecting and channelling position to the substantially inverted cleaning position;

maintaining the gutter member in the substantially inverted cleaning position for a predetermined period of time; and causing the remotely operable actuator to generate a pulling force by retracting the tube portion to return the gutter member from the substantially inverted cleaning position to the in-use collecting and channelling position, and wherein the remotely operable actuator is positioned outside of or underneath the gutter member.

17. The method of claim 16, preceded by the step of programming the remotely operable actuator to cause the gutter member to move between the in-use collecting and channelling position and the cleaning position at predetermined intervals.

18. The method of claim 16, wherein the remotely operable actuator is programmed to move the gutter members between the in-use collecting and channelling position and the cleaning position simultaneously or sequentially.

* * * * *

UNITED STATES PATENT AND TRADEMARK OFFICE

CERTIFICATE OF CORRECTION

PATENT NO. : 8,215,080 B2
APPLICATION NO. : 12/399771
DATED : July 10, 2012
INVENTOR(S) : Raibeart W. McNeish and Liam Rossney It is certified that error appears in the above-identified patent and that said Letters Patent is hereby corrected as shown below:

On the Title Page Under (75) Inventors: Delete "Liem" and replace with
-- Liam --

On the Title Page Under (75) Inventors: Delete "Wantime" and replace with
-- Wantirna --

On the Title Page after "(22) Filed: Mar. 6, 2009" Insert the following: -- (30) Foreign Application Priority Data Australia PCT/AU2006/001317 09/08/2006 --

Signed and Sealed this
Twenty-third Day of October, 2012

David J. Kappos

David J. Kappos
*Director of the United States Patent and Trademark Office*